US007453402B2

(12) United States Patent
Rowell et al.

(10) Patent No.: US 7,453,402 B2
(45) Date of Patent: Nov. 18, 2008

(54) MINIATURE BALANCED ANTENNA WITH DIFFERENTIAL FEED

(75) Inventors: Corbett Rowell, Shatin (HK); Chi Lun Mak, Shatin (HK)

(73) Assignee: Hong Kong Applied Science and Research Institute Co., Ltd., Hong Kong (CN)

( * ) Notice: Subject to any disclaimer, the term of this patent is extended or adjusted under 35 U.S.C. 154(b) by 26 days.

(21) Appl. No.: 11/455,526

(22) Filed: Jun. 19, 2006

(65) Prior Publication Data

US 2007/0290927 A1 Dec. 20, 2007

(51) Int. Cl.
*H01Q 19/10* (2006.01)

(52) U.S. Cl. ..... 343/700 MS; 343/834

(58) Field of Classification Search ..... 343/833, 343/834, 793, 815, 700 MS, 702, 817, 795
See application file for complete search history.

(56) References Cited

U.S. PATENT DOCUMENTS

| | | | | |
|---|---|---|---|---|
| 5,323,169 | A | 6/1994 | Koslover | |
| 5,471,223 | A | 11/1995 | McCorkle | |
| 6,650,294 | B2 | 11/2003 | Ying et al. | |
| 6,999,030 | B1 | 2/2006 | Mateychuk | |
| 7,053,844 | B2 * | 5/2006 | Gaucher et al. | 343/702 |
| 7,126,545 | B2 * | 10/2006 | Nagano et al. | 343/702 |
| 7,202,818 | B2 * | 4/2007 | Anguera Pros et al. | 343/700 MS |
| 2002/0053994 | A1 | 5/2002 | McCorkle | |
| 2002/0122010 | A1 | 9/2002 | McCorkle | |
| 2003/0078012 | A1 * | 4/2003 | Ito et al. | 455/82 |
| 2003/0231138 | A1 * | 12/2003 | Weinstein | 343/795 |
| 2005/0156787 | A1 | 7/2005 | Myoung et al. | |
| 2005/0156788 | A1 | 7/2005 | Lin | |
| 2005/0184919 | A1 | 8/2005 | Yekeh Yazdandoost et al. | |
| 2005/0280582 | A1 | 12/2005 | Powell et al. | |

FOREIGN PATENT DOCUMENTS

| | | |
|---|---|---|
| EP | 1 531 516 A1 | 5/2005 |

OTHER PUBLICATIONS

International Search Report issued for PCT/CN2007/070107, dated Sep. 20, 2007; 2 pages.

* cited by examiner

*Primary Examiner*—Trinh V Dinh
*Assistant Examiner*—Dieu Hien T Duong
(74) *Attorney, Agent, or Firm*—Fulbright & Jaworski L.L.P.

(57) ABSTRACT

An example antenna system includes a parasitic element and a symmetrical element fed by a balanced RF signal source. The fed element is operable to couple with the parasitic element, thereby causing the parasitic element to resonate at a first frequency band. Thus, the fed element is operable to act as a balanced capacitive feed for the parasitic element. Also, the parasitic element is symmetrical with respect to a polarity of the fed element.

15 Claims, 4 Drawing Sheets

MINIATURE BALANCED ANTENNA WITH DIFFERENTIAL FEED

TECHNICAL FIELD

The present invention relates in general to antenna systems and, more specifically, to balanced antenna systems with differential feeds. The invention further relates to miniaturized antenna systems with wide bandwidth operations.

BACKGROUND OF THE INVENTION

Prior art systems, both consumer systems and commercial systems, typically employ unbalanced antennas for transmitting and receiving Radio Frequency (RF) signals. Most unbalanced antennas have asymmetrical radiating portions and are fed by unbalanced transmission lines (e.g. coaxial cable or microstrip line) or sources. An example of an unbalanced antenna is a common monopole antenna system that has a single antenna element (a vertical straight metallic post with quarter freespace wavelength long, $\lambda_0/4$) that is mirrored by a flat horizontal ground plane. There are several reasons why prior art systems employ unbalanced antennas. For instance, much of the commercially available measurement equipment is designed to measure unbalanced antennas. Also, it is often true that for a particular design an unbalanced antenna is smaller in size than its corresponding balanced design. In general, it is more or less halved. For example, a monopole antenna (resonant length $\lambda_0/4$) is half of the size of a dipole antenna (resonant length $\lambda_0/2$) for use in the same frequency band. Still further, there are four or five decades of unbalanced antenna engineering and research, such that most designers are more familiar or comfortable with unbalanced systems than with balanced systems.

Many current wireless applications include a low noise amplifier (LNA) or power amplifier (PA) connecting to an antenna element for signal reception or transmission. PAs/LNAs typically have differential, balanced output/input ports. In the signal reception path, in order to connect an unbalanced antenna element to the balanced LNA input, prior art systems include a balun (Balanced Unbalanced transformation) therebetween. In such applications, the balun receives an unbalanced input and transforms it into a balanced output, thereby matching the antenna element to the LNA, but with some amount of loss. In narrow band applications, the loss may be within an acceptable range. However, baluns adapted for use in wide band applications tend to cause loss that may be unacceptable for some devices. Moreover, baluns with wide band characteristic are usually complex and tend to increase design and manufacturing costs. Furthermore, the performance of unbalanced antennas is highly influenced by the geometry of an associated ground plane, especially for ground plane size around $0.25\lambda_0$-$2\lambda_0$, thereby requiring design efforts not only to make a ground plane that can accommodate device circuitry but also to make a ground plane with desirable RF performance.

By contrast, prior art balanced antenna systems tend to be large, and thus, are generally limited to applications wherein minimal loss is more important than space. Further, balanced antenna systems often employ complex impedance matching circuits that are expensive and/or hard to design.

BRIEF SUMMARY OF THE INVENTION

Various embodiments of the present invention include systems and methods for communication using balanced antenna systems. The following discussion describes one or more examples. In one embodiment, an antenna system includes two metallic portions separated by a capacitive gap, wherein the first portion is connected to differential inputs from a pair of transmission lines and designated as "fed element", and the second portion is electromagnetically coupled by the fed element through the gap and acts as a "parasitic element". The example antenna system, i.e. both fed and parasitic elements, is ungrounded and provides wideband performance. Further, the system is symmetrical in geometry. RF energy from the differential inputs excites and resonates the fed element, and in turn, the parasitic element by electromagnetic coupling. Both fed and parasitic elements interact mutually and resonate at their specific frequencies causing radiation of RF energy.

This embodiment can be designed to provide performance in one or more bands, including at least one wide band made from overlapping resonant frequency bands from both fed and parasitic elements. Accordingly, the example embodiment can be adapted for use in wide band applications, including, e.g., Ultra Wide Band (UWB) devices. UWB differs by geographic locations, and it can include large portions of the spectrum from, for example, 3.1 GHz to 10.6 GHz in the United States or from 3.1 GHz to 4.7 GHz in Hong Kong.

Between the fed element and the parasitic element is a dielectric gap that can be designed to provide impedance matching for the whole antenna system, possibly eliminating the need for a complex impedance matching network. Further, the balanced nature of this example antenna system dispenses with the need for a lossy balun that decreases performance in prior art systems.

While some embodiments use a straight parasitic element placed nearby the fed element, the footprint of this example embodiment can be made smaller by conforming the shape of the parasitic element to the shape of the fed element. In one example, the parasitic element "wraps around" the fed element, thereby surrounding at least part of the fed element and minimizing a width of the antenna system.

In an example method, balanced signals from a pair of transmission lines, are sent to the fed element, causing the parasitic element and/or the fed element to resonate in one or more frequency bands. Additionally, the dielectric gap introduces some reactance, together with appropriate balanced feed location, thereby providing impedance matching to the antenna system.

Planar antennas, due to conformal structure, can be used for some embodiments, specifically, for internal antenna design for small devices such as cellular phones or USB dongle. Planar antennas can be classified as grounded or ungrounded. Grounded antenna refers to the geometry that a metallic ground plane (e.g. PCB ground) is underneath the antenna element, conventional microstrip patch antennas and PIFA are typical examples. Grounded antenna in general exhibits narrower bandwidth than ungrounded antenna due to its higher Q factor. Hence, for internal antenna design with wide bandwidth feature, ungrounded planar antennas are generally more favorable.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
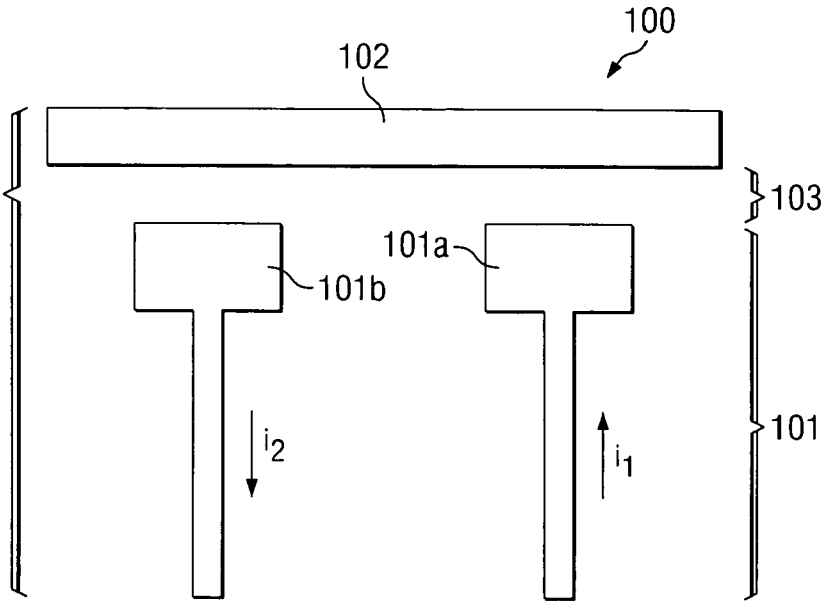
FIG. 1 is an illustration of an exemplary antenna system adapted according to one embodiment of the invention.

FIG. 1 is an illustration of exemplary antenna system 100 adapted according to one embodiment of the invention, System 100 includes metallic fed element 101 and metallic parasitic element 102. Individual fed element 101*a* and 101*b* are "balanced" in that their currents (or potentials) are equal in magnitude and completely out of phase along their respective paths. Accordingly, it is also true that fed element 101 is a differential structure, with one side acting as a "+" side and the other side acting as a "−" side. Gap 103 is a dielectric gap and may include air, plastic, fiberglass, or other dielectric materials.

Metallic element 102 is a parasitic element that is symmetrical with respect to the polarity of fed element 101 and is separated therefrom by gap 103. Parasitic element 102 has one or more resonating frequencies, and when RF signals are provided to fed element 101 at a resonating frequency, parasitic element 102 resonates due to capacitive coupling. Fed element 101 also has one or more resonant frequencies, such that system 100 may provide signals that include components from the resonant frequencies of parasitic element 102 and fed element 101. Thus, fed element 101 acts as a balanced capacitive feed for parasitic element 102. System 100 may be described as a balanced antenna system with a differential capacitive coupling within the antenna.

Figure 2:
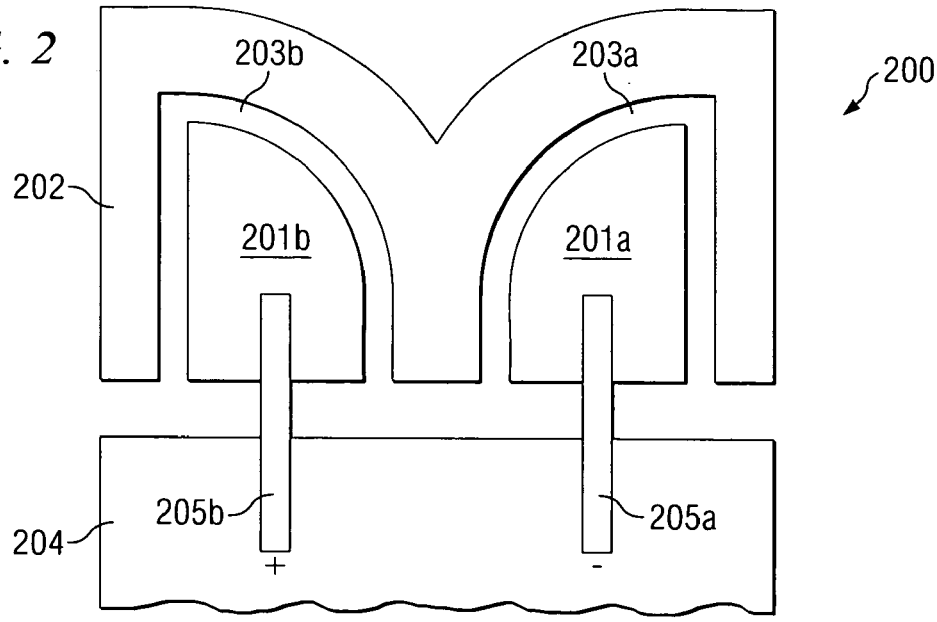
FIG. 2 is an illustration of an exemplary antenna system adapted according to one embodiment of the invention.

FIG. 2 is an illustration of exemplary antenna system 200 adapted according to one embodiment of the invention. System 200 includes fed, element 201 (including individual elements 201*a* and 201*b*) that is connected to alternating "+" and signals by transmission lines 205*b* and 205*a*, respectively. The alternating "+" and signals may be provided by, e.g., a balanced output from a Power Amplifier (PA, not shown) mounted to ground plane 204. Both fed element 201 and parasitic element 202 are ungrounded and separated by dielectric gaps 203*a* and 203*b*. In this example, ground plane 204 is coplanar with both fed element 201 and parasitic element 202.

Parasitic element 202 and fed element 201 are symmetric about an axis drawn between the "+" and "−" sides, and transmission lines 205*a* and 205*b* provide a differential signal to fed element 201; thus, antenna system 200 is a balanced antenna. Ground plane 204 may or may not be symmetrical, depending on the application. Balanced antennas are generally minimally affected by the shape of associated ground planes such that many applications are tolerant of various ground plane shapes.

In this example, parasitic element 202 is operable to resonate in a first frequency band, and fed element 201 is operable to resonate in second frequency band. The first and second bands may be separate and/or overlapping and are dependent, at least in part, on the shapes and sizes of element 202 and element 201. Parasitic element 202 in system 200 has its own native resonant frequencies and acts as a capacitive load on fed element 201, thereby decreasing the native frequencies of fed element 201 slightly. System 200 is operable to resonate at least in the first and second frequency bands. Thus, it is possible in some examples to design system 200 to provide communications in two separate bands or, when the frequency bands overlap, in a single band that spans the two bands.

In system 200, fed element 201 has a resonant frequency that is somewhat higher than the resonant frequency of parasitic element 202 due to the larger size and total length of parasitic element 202. By changing the shape and size of either or both of parasitic element 202 and fed element 201, an engineer can design system 200 to operate at various desired frequency bands.

System 200 includes gap 203 between parasitic element 202 and fed element 201. Gap 203 in this example is designed to provide impedance matching for the system by providing appropriate reactance. Its values vary with shape and width, and generally, a wider gap provides greater capacitance. Gap 203 can include any kind of insulator, such that it may be an air gap, plastic gap, mixed dielectric, or the like. When system 200 is disposed on a Printed Circuit Board (PCB), gap 203 may include air and fiberglass. In various embodiments, gap 203 is not limited to any particular kind of insulator. Further, in some embodiments, the width of gap 203 may vary, such that it is wider in some portions and narrower in others.

When compared to parasitic element 102 (FIG. 1), parasitic element 202 uses space more efficiently. For instance, parasitic element 202 is designed such that it conforms in two dimensions (e.g., length, width) to the shape of fed element 201. Further, parasitic element 202 does not extend past the width of ground plane 204, unlike system 100 wherein parasitic element 102 extends past the width of fed element 101. The example shape of parasitic element 202 allows it to resonate at a desired frequency while fitting within a compact application, such as a cell phone, Personal Digital Assistant (PDA), handheld device, or other small electronic device. The shape of parasitic element 202, the shape of fed element 201, and the width of dielectric gap 203 at various portions of system 200 contribute to the resonances of system 200.

Figure 3:
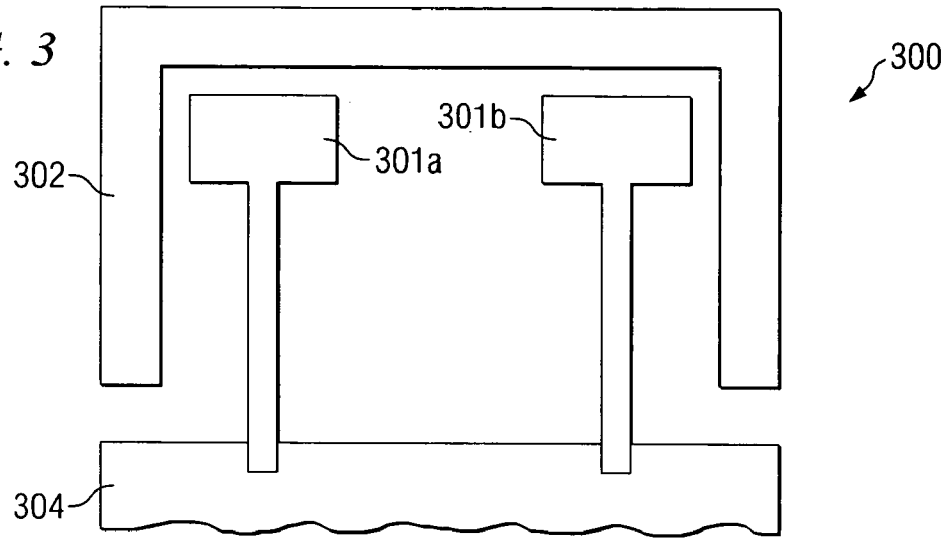
FIG. 3 is an illustration of an exemplary antenna system adapted according to one embodiment of the invention.

FIG. 3 is an illustration of exemplary antenna system 300 adapted according to one embodiment of the invention. System 300 uses bent parasitic element 302 to provide space efficiency by conforming to a shape of fed element 301. This is in comparison to the "M" shape of parasitic element 202 (FIG. 2), though in these examples, both offer performance in wide frequency bands (because of their respective dimensions) while not extending past a width of ground planes 204 and 304. Various embodiments of the invention are not limited to any particular geometry. Whether "M" shaped, bent at right angles, gently curved, or the like, parasitic elements may be adapted for a variety of applications by designing such elements for resonant frequency bands while minding the available space for the device. Further, while both parasitic elements 202 and 302 conform to the shapes of their respective fed elements, parasitic element 202 may be described as surrounding fed element 201 in conjunction with ground plane 204, whereas parasitic element 302 and ground plane 304 do not surround the entire length of fed element 301. A variety of geometries are possible in various embodiments of the present invention.

Figure 4:
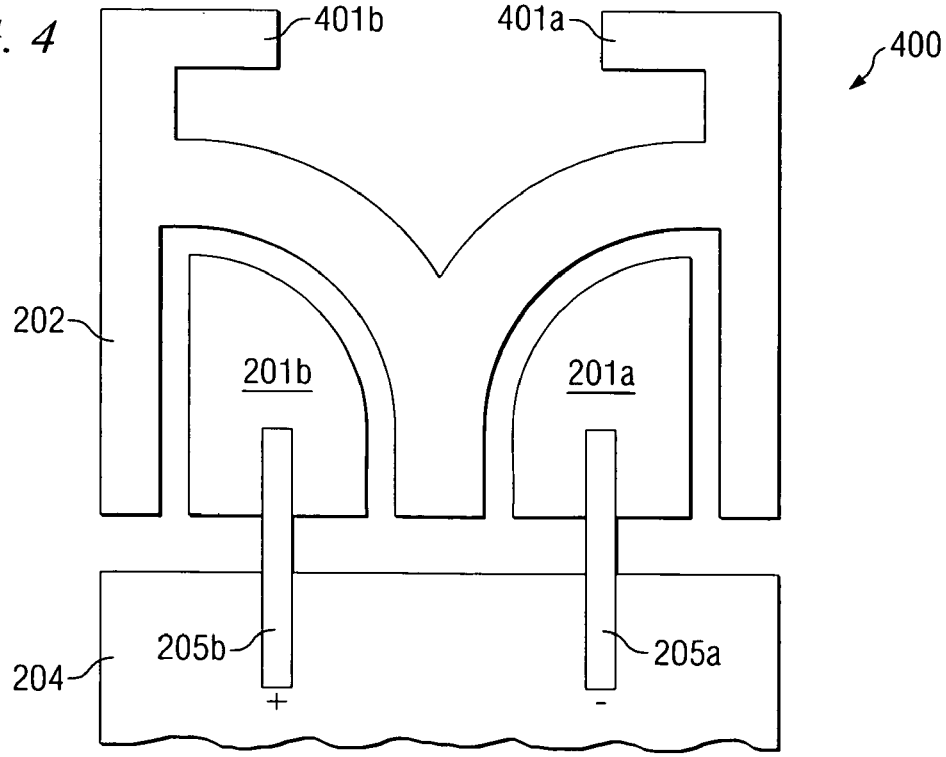
FIG. 4 is an illustration of an exemplary antenna system adapted according to one embodiment of the invention.

FIG. 4 is an illustration of exemplary antenna system 400 adapted according to one embodiment of the invention. System 400 is similar to system 200 (FIG. 2), except that it includes stub elements 401*a* and 401*b* as part of parasitic element 202. Stub elements 401*a* and 401*b* improve the frequency performance of parasitic element 202 by increasing the lower portion of the native frequency band of parasitic element 202, thereby enhancing performance of system 400 at its lowest frequencies.

Figure 5:
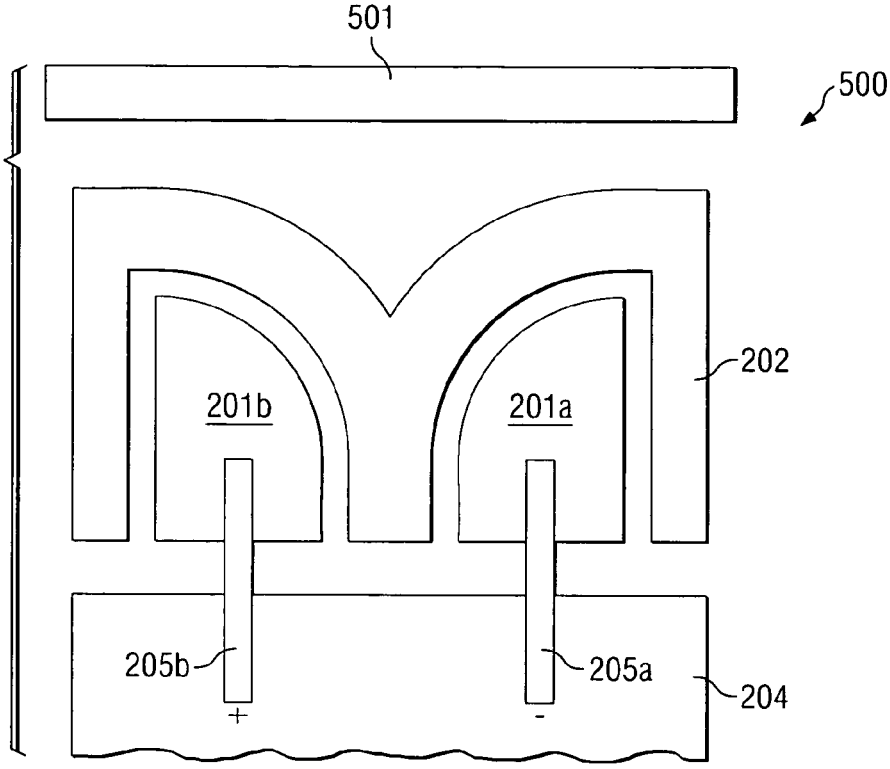
FIG. 5 is an illustration of an exemplary antenna system adapted according to one embodiment of the invention.

FIG. 5 is an illustration of exemplary antenna system 500 adapted according to one embodiment of the invention. System 500 is similar to system 200 (FIG. 2) except that it includes additional parasitic strip 501. Additional parasitic strip 501 acts as a director element to focus the radiation of system 500 in one or more directions. Depending on the application, additional parasitic strip 501 may extend beyond the width of ground plane 204. In this example, additional parasitic strip 501 is coplanar with parasitic element 202 and fed element 201. Further, another additional coplanar parasitic strip (not shown) may be added to system 500, increasing the directivity thereof. Parasitic strip 501 may be used in addition to stub elements 401 (FIG. 4) in some embodiments. Apart from acting as a director element, additional parasitic strip 501 and another additional parasitic strip (not shown) can also perform as an additional matching element in the system to provide extra wideband operation.

Figure 6A:
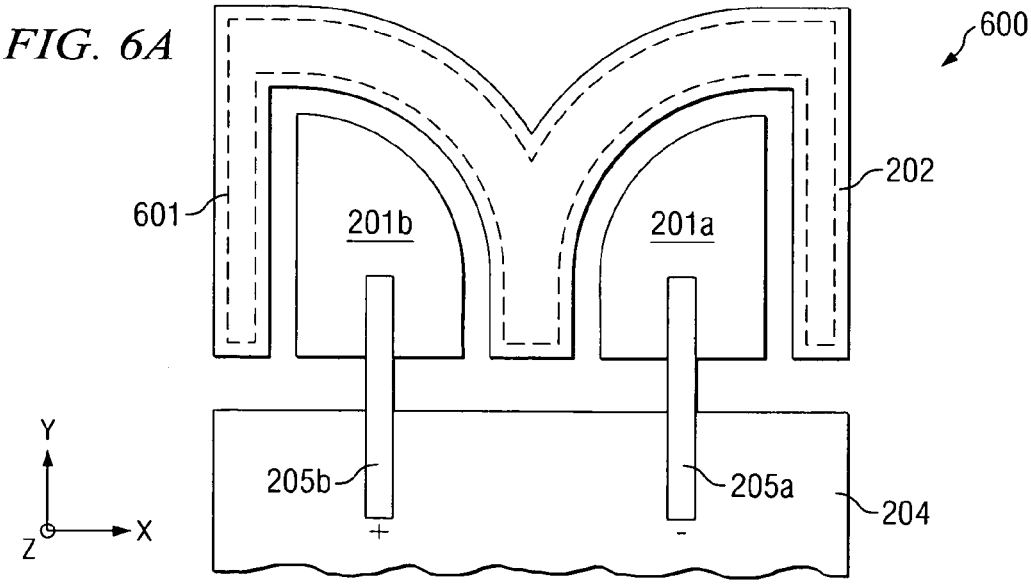
FIGS. 6A and 6B are illustrations of an exemplary antenna system adapted according to one embodiment of the invention.
Figure 6B:
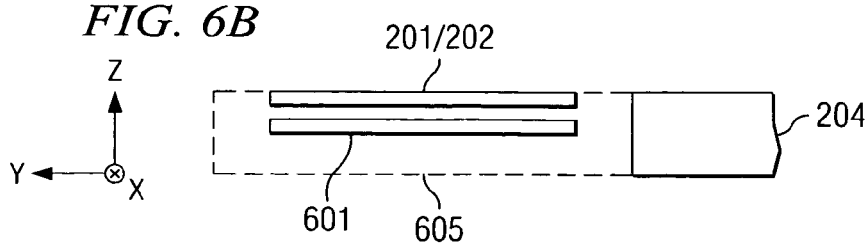

FIGS. 6A and 6B are illustrations of exemplary antenna system 600 adapted according to one embodiment of the invention. System 600 includes two layers of parasitic elements—202 and 601. In various embodiments antenna systems are disposed on PCBs, such as PCB 605 (shown in dashed line so as not to obscure items 201, 202, and 601), which are often made of multiple layers. In system 600, parasitic element 601 is disposed in a layer underneath that of parasitic element 202. Element 601 of system 600 performs as an additional matching element. Parasitic element 601 matches antenna system 600 at different frequency bands by creating extra resonances. One or more additional parasitic elements at other levels of PCB 605 are adaptable for use in some embodiments, thereby providing more resonances.

Figure 7:
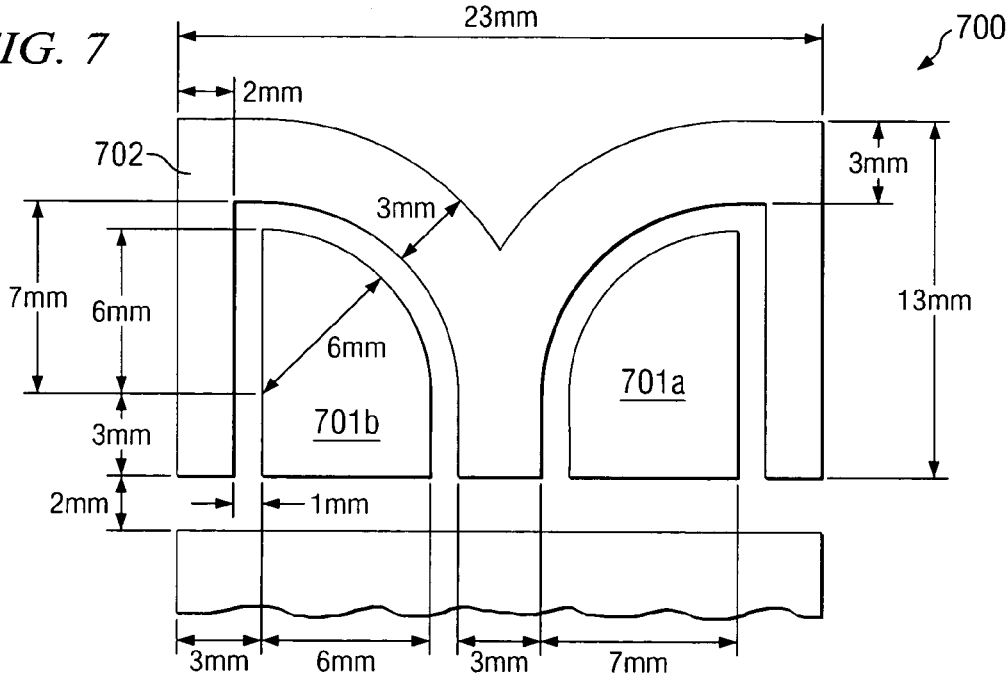
FIG. 7 is an illustration of an exemplary antenna system adapted according to one embodiment of the invention.

FIG. 7 is an illustration of exemplary antenna system 700 adapted according to one embodiment of the invention. System 700 is specifically adapted to provide performance in the band extending from 3.1 GHz to 4.7 GHz (UWB in Hong Kong). The dimensions are shown, and it should be noted that the radiating portion of system 700 has a footprint of thirteen by twenty three millimeters. In other words, system 700 provides better performance with a similar or smaller footprint than unbalanced prior art systems for the same frequency band. It should also be noted that the shape and dimensions of system 700 (and, for that matter, of the other exemplary systems herein) are for example only, and other shapes and/or dimensions can be designed for given performance specifications in a wide variety of applications. In fact, various embodiments of the invention are not limited to any particular shape or size or frequency band.

Figure 8:
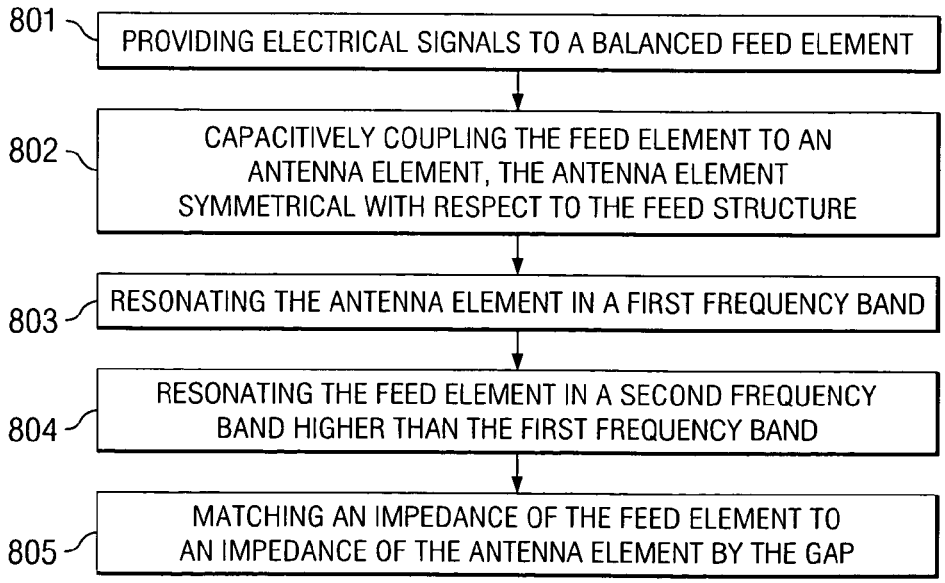
FIG. 8 is an illustration of an exemplary method for producing electromagnetic signals by an antenna system.

FIG. 8 is an illustration of exemplary method 800 for producing electromagnetic signals by an antenna system. In step 801 RF signals are provided to a balanced fed element. The signals can be provided through, for example, a coaxial cable or other type of transmission line from a signal source, such as an RF module with a differential PA. Further, the signals are differential, and currents in the transmission paths are equal in magnitude and opposite in direction at respective symmetrical points. In this example, the electrical signals represent information and contain signals in one or more frequency bands corresponding to one or more resonant frequencies of components of the antenna system.

In step 802, the fed element is capacitively coupled to a parasitic element, and the parasitic element is symmetrical with respect to the fed element. In this example, the fed element is separated from the parasitic clement by a dielectric gap, such that the fed element acts as a capacitive type feed coupled to the parasitic element. Further, the parasitic element is symmetrical with respect to the fed clement so that each half (i.e., "+" and "−" sides) of the fed element excites a portion of the parasitic element that is symmetric to the portion excited by the other half. Thus, currents in symmetrically corresponding points of the parasitic element are equal in magnitude and opposite in direction. Additionally, in this example, the parasitic element and fed element are ungrounded.

In step 803, the parasitic element is resonated in a first frequency band. In this example, the electrical signals and the capacitive coupling cause the parasitic element to resonate in its native frequency band.

In step 804, the fed element is resonated in a second frequency band higher than the first frequency band. In this example, the fed element is designed such that it has a resonant frequency that is higher than that of the parasitic element. An example of such a system is shown in FIG. 2, wherein both of the individual portions of fed element 201 are smaller than parasitic element 202, and, therefore, the fed element resonates at a higher frequency than does the parasitic element. It should be noted that the parasitic element will act as a capacitive load and decrease the native frequency of the fed element slightly during operation. Various embodiments of the system are not limited to having a fed element that resonates at a frequency band higher than that of the parasitic element. In fact, it is possible in some embodiments to design an antenna system wherein the fed element resonates at a frequency band similar to or lower than that of the parasitic element.

In one example system, the parasitic element and the fed element are designed such that their respective resonant frequencies provide coverage of a wide frequency band. This can be accomplished by designing the parasitic element and the fed element to have overlapping resonant frequency bands, which, when taken together, cover a particular spectrum. An example of such system is shown in FIG. 7, wherein parasitic element 702 and fed element 701 are designed to provide coverage from 3.1 GHz to 4.7 GHz, with parasitic element 702 providing coverage in the lower portion of the band and fed element 701 providing coverage in the higher portion of the band. In alternative embodiments, the fed element can be designed to have a resonant frequency that does not overlap with that of the parasitic element.

In step 805, impedance of the antenna system is matched by the dielectric gap. In this example, the dielectric gap is designed such that it provides reactance in the antenna system. The width and shape of the gap determine the value of the reactance. Accordingly, in this example, the shape and width of the gap is made so that the reactance effectively provides impedance matching for the antenna system.

Various embodiments of the invention are not limited to any particular order of steps 801 805. In fact, in many applications, the steps will occur nearly simultaneously, discounting the time it takes for the system to reach steady state.

Some embodiments of the invention provide one or more advantages over prior art systems. For instance, some embodiments are substantially unaffected by variations in the shape of the ground plane, providing a device designer with much flexibility when deciding upon a shape of the ground plane. In other words, some embodiments can be conveniently integrated with various existing RF modules which have different ground plane geometry. Further, since various embodiments require no balun, those systems can provide lower loss performance than prior art unbalanced systems.

In embodiments that conform the parasitic element to the shape of the fed element in at least two dimensions, a compactness can be achieved that is comparable to or better than that achieved by unbalanced systems while providing wide band performance in e.g., the UWB spectrum. Further, since most commercially available Radio Frequency (RF) modules are balanced, various embodiments can be adapted to work with those components with minimal modifications to their system designs.

Also, various embodiments use a simple structure that can be disposed on a PCB. In fact, the fed element and parasitic element of various embodiments can be disposed on a single PCB layer with electrical signals supplied from the same or different layer through traces and/or vias. Accordingly, production costs can be comparable to lesser performing prior art devices.

In addition, various embodiments that use a gap between the parasitic element and the fed element to perform impedance matching may be able to achieve acceptable matching without the use of a separate matching network. In some embodiments it is less complicated to design gap geometry than it is to design a matching network. Thus, various embodiments may have lower design and production costs than prior art systems that include matching networks.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

a parasitic element; and a balanced element fed by a differential radio frequency (RF) source, said balanced fed element operable to capacitively couple with said parasitic element, thereby causing said parasitic element to resonate at a first frequency band, said parasitic element symmetrical with respect to an axis drawn between positive and negative sides of said balanced fed element;

wherein a shape of said parasitic element conforms to a shape of said balanced fed element in at least a length and a width dimension, and said parasitic element is configured in an "M" shape.

2. The system of claim 1 wherein said balanced fed element is adapted to resonate at a second frequency band higher than said first frequency band.

3. The antenna system of claim 1, wherein said antenna system is ungrounded and said parasitic element conforms in at least two dimensions to a shape of said balanced fed element.

4. The system of claim 1 wherein said parasitic element is adapted to behave as a capacitive load in electromagnetic communication with said balanced fed element.

5. The system of claim 4 wherein said balanced fed element and said parasitic element are separated by a gap of dielectric material, said gap adapted to provide impedance matching between said fed element and said parasitic element.

6. The system of claim 1 wherein said parasitic element includes at least two stub elements.

7. The system of claim 1 wherein said antenna system further comprises:

an additional parasitic element, wherein said parasitic element is disposed between said balanced fed element and said additional parasitic element.

8. The system of claim 1 wherein said balanced fed element and said parasitic element are coplanar.

9. The system of claim 8 wherein said antenna system is disposed on a Printed Circuit Board (PCB).

10. The system of claim 9 wherein said antenna system is adapted to provide communications across the 3.1 GHz to 4.7 GHz frequency band.

11. The system of claim 9 wherein said PCB includes an additional parasitic element in a layer below a layer that includes said parasitic element.

12. The system of claim 1 wherein said balanced fed element and said parasitic element are separated by a gap of dielectric material.

13. The system of claim 12 wherein said antenna system further comprises a ground plane separated from said parasitic element and said balanced fed element by at least one other dielectric gap.

14. The system of claim 13 wherein a width of said parasitic element is smaller than or equal to a width of said ground plane.

15. The system of claim 14 wherein said parasitic element and said ground plane surround said balanced fed element.

* * * * *

UNITED STATES PATENT AND TRADEMARK OFFICE

CERTIFICATE OF CORRECTION

PATENT NO. : 7,453,402 B2
APPLICATION NO. : 11/455526
DATED : November 18, 2008
INVENTOR(S) : Corbett R. Rowell et al.

It is certified that error appears in the above-identified patent and that said Letters Patent is hereby corrected as shown below:

In the specification:

Column 3, Line 61, delete the portion of text after the phrase "200 includes fed" reading ",".

Column 3, Lines 62-63, delete the portion of text reading "alternating "+" and signals" and replace with --alternating "+" and "-" signals--.

Column 3, Line 64, delete the portion of text reading "alternating "+" and signals" and replace with --alternating "+" and "-" signals--.

In the claims:

Column 8, Claim 5, Line 28, delete the portion of text reading "said fed element" and replace with --said balanced fed element--.

Signed and Sealed this

Sixteenth Day of June, 2009

John Doll

JOHN DOLL
*Acting Director of the United States Patent and Trademark Office*